US006293661B1

(12) United States Patent
Abe et al.

(10) Patent No.: US 6,293,661 B1
(45) **Date of Patent: *Sep. 25, 2001**

(54) INK CONTAINER

(75) Inventors: Tsutomu Abe, Isehara; Keisuke Matsuo, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/131,660

(22) Filed: Aug. 10, 1998

Related U.S. Application Data

(62) Division of application No. 08/579,357, filed on Dec. 27, 1995, now Pat. No. 5,903,292.

(30) Foreign Application Priority Data

| | | |
|---|---|---|
| Dec. 28, 1994 | (JP) | 6-327882 |
| Dec. 28, 1994 | (JP) | 6-328741 |
| Dec. 8, 1995 | (JP) | 7-320899 |

(51) Int. Cl.[7] ..... B41J 2/175
(52) U.S. Cl. ..... 347/86
(58) Field of Search ..... 347/7, 85, 86, 347/87

(56) References Cited

U.S. PATENT DOCUMENTS

| | | | | |
|---|---|---|---|---|
| 4,636,814 | * | 1/1987 | Terasawa | 347/86 |
| 4,794,409 | | 12/1988 | Cowger et al. . | |
| 5,155,502 | | 10/1992 | Kimura et al. . | |
| 5,502,479 | | 3/1996 | Ishinaga et al. | 347/93 |
| 5,509,140 | | 4/1996 | Koitabashi et al. | 347/86 |
| 5,619,238 | | 4/1997 | Higuma et al. | 347/86 |
| 5,712,667 | * | 1/1998 | Sato | 347/7 |

FOREIGN PATENT DOCUMENTS

| | | |
|---|---|---|
| 0466093 | 1/1992 | (EP) . |
| 0625424 | 11/1994 | (EP) . |
| 2-000522 | 1/1990 | (JP) . |
| 6-328710 | 11/1994 | (JP) . |
| 6-328713 | 11/1994 | (JP) . |
| 7-125232 | 5/1995 | (JP) . |

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

An ink container connectable with an ink jet head detachably mountable to an ink jet device, the ink container includes a container body; a partition wall dividing an inside of the body into a first accommodating chamber and a second accommodating chamber; wherein the first accommodating chamber contains a negative pressure producing member and is provided with an ink supply opening connected with the ink jet head to supply ink and an air vent portion for communication with the ambience, the ink supply opening being formed in a wall faced to the partition wall; wherein the partition wall is provided with a fine communicating portion which is effective to permit movement of the ink from the second accommodating chamber to the first accommodating chamber and to permit movement of the air from the first accommodating chamber to the second accommodating chamber; and wherein such a portion of the negative pressure producing member as is in a path connecting ink supply opening and the fine communicating portion is more compressed than another portion thereof.

29 Claims, 12 Drawing Sheets

INK CONTAINER

This application is a division of application Ser. No. 08/579,357, filed Dec. 27, 1995, now U.S. Pat. No. 5,903, 292.

FIELD OF THE INVENTION AND RELATED ART

The present invention relates to an ink container for containing ink for ink jet recording, an ink jet cartridge provided with a recording head, and a manufacturing method for manufacturing the same. The present invention is applicable to recording equipment, communication equipment, office equipment, compound equipment, printer or the like such as a copying machine, a facsimile machine or the like using ink jet technique. Here, the recording covers not only an image of sense such as letter or the like but also an image of no sense such as a pattern image or the like. The recording equipment includes information processing apparatuses printers as output devices therefor.

Recording devices of thermal transfer, laser beam, dot impact, ink jet types are used for output devices in personal computer terminals, copying machines, facsimile machines or the like. Among various recording types, the ink-jet type is particularly noted as a printing method excellent in low-noise property, among the ink jet printer type machines, the type using bubble generation of liquid by heating, is further particularly noted because high density recording head is easy to manufacture; the low-noise property is excellent; color printing is easy; high speed printing is possible; high quality printing is possible with low cost. In an example of a recording means for the ink jet recording device, the ink jet recording head and an ink container for retaining the ink to be supplied to the ink jet recording head are unified, and they are exchangeably mounted as a unit to a scanning carriage of the device (ink jet cartridge).

Such an ink jet cartridge is thrown away when the ink in the ink container becomes unable to be ejected from the recording head. In the ink container of the ink jet cartridge, there is provided a negative pressure producing member which is capable of retaining ink while generating a desired negative pressure in the recording head. With the consumption of the ink, the negative pressure produced by the negative pressure producing member increases gradually. Then, the ink is not refilled properly in response to the ejection of the ink from the recording head. Finally, the ink jet cartridge becomes non-usable. In such a cartridge, a relatively large amount of the ink remains although the amount is dependent on the performance of the negative pressure producing member. The remaining amount of the ink is determined by the ink retaining power of the sponge namely the negative pressure producing member occupying substantially the entirety of the ink container, and therefore, it is not easy to improve the performance of the sponge.

The negative pressure produced by the negative pressure producing member gradually increases in response to the ink consumption, and therefore, it is difficult to maintain a substantially constant negative pressure from the start of the use to the end of service life thereof. On the other hand, an ink jet cartridge has been proposed which contains substantially only the ink.

On the other hand, an ink jet cartridge containing substantially only ink has been proposed. For example, Japanese Laid Open Patent Application No. HEI-2-522 discloses an ink jet cartridge comprising a primary ink storing portion for containing a large amount of ink only at an upper position, and a small porous member at a lower position before the ink jet recording head. In this case, it is described that the porous member is not contained in the ink storing portion, but is posited in the ink flow path, by which the use efficiency is improved. In addition, a secondary ink storing portion is provided as a space holdable of the ink at the side of the porous member, upon the temperature rise (pressure decrease), or the like, the air in the primary ink storing portion expands so as to push the ink in the primary ink storing portion out, but the ink can be stored there, so that the negative pressure of the recording head during the recording can be maintained substantially constant.

On the other hand, Japanese Laid Open Patent Application No. HEI-7-125232 discloses that the inside of the ink container portion is divided substantially equally by a wall into two chambers, and a negative pressure producing member is contained in the chamber closer to the recording head. Between the partition wall and the bottom portion, a communicating portion is provided to permit ink supply. In this case, the recording head portion and the ink container portion are separable. When the recording head portion is mounted to the ink container portion, the ink supply tube of the recording head portion is inserted into the negative pressure producing member side of the ink container portion so that the negative pressure producing member is compressed adjacent the ink supply tube.

When this structure of the ink container portion is applied to an ink Jet cartridge integrally having the recording head, a satisfactory result has been confirmed as long as the ink supply is concerned. However, the stability during transportation is not good. For example, the air enters the negative pressure producing member upon the change of the situation such as positions of the cartridge, temperature or pressure change, vibration, impact or the like, with the result of the ink distribution change. This may result in a non-uniform distribution of the ink retained in the negative pressure producing member disposed in the region between the communicating portion and the ink supply tube. If it is mounted to the recording device, and the initial recovering operation is carried out, the air in the ink passage between the communication portion and the ink supply tube moves toward the ink supply tube with the possible result of discontinuity of the ink path. In the case of the ink container disclosed in Japanese Laid Open Patent Application No. Hei-7-125232, the negative pressure producing material is inserted into a casing having an open bottom, through the open bottom, and then, the bottom is closed. This will not be used easily for an ink jet cartridge integrally having a recording head.

SUMMARY OF THE INVENTION

Accordingly, it is a principal object of the present invention to provide an ink container, an ink jet cartridge and a manufacturing method for the cartridge, wherein the ink can be supplied to the recording head stably at all times irrespective of the transportation, pose and ambient condition experienced.

It is another object of the present invention to provide an ink container, an ink jet cartridge and a manufacturing method for the ink jet cartridge, with which cost is low without difficulty.

According to an aspect of the present invention, there is provided an ink container connectable with an ink jet head detachably mountable to an ink jet device, said ink container comprising a container body; a partition wall dividing an inside of said body into a first accommodating chamber and a second accommodating chamber; wherein said first accommodating chamber contains a negative pressure producing member and is provided with an ink supply opening connected with said ink jet head to supply ink and an air vent portion for communication with the ambience, said ink supply opening being formed in a wall faced to said partition wall; wherein said partition wall is provided with a fine communicating portion which is effective to permit movement of the ink from said second accommodating chamber to said first accommodating chamber and to permit movement of the air from said first accommodating chamber to said second accommodating chamber; and wherein such a portion of said negative pressure producing member as is in a path connecting ink supply opening and said fine communicating portion is more compressed than another portion thereof.

According to another aspect of the present invention, there is provided an ink container connectable with an ink jet head detachably mountable to an ink jet device, comprising: a container having an open end; a ink supply opening formed in a side faced to said opening portion; a negative pressure producing member inserted through said opening portion so as to be contacted to a side faced to said opening portion; a partition wall contacted to said negative pressure producing member and harmetically contacted to internal walls to divide said container into a first accommodation portion and a second accommodation portion, said partition wall having a fine communicating portion for communication between said first accommodation portion and said second accommodation portion; a cap member for constituting said second accommodating chamber with said partition wall by closing the opening portion of said container; and wherein such a portion of said negative pressure producing member as is interposed between said ink supply opening and said fine communicating portion is compressed more than another portion.

According to further aspect of the present invention, there is provided a manufacturing method of an ink container detachably mountable relative to an ink jet printer, comprising the steps of providing a container having an opening at an end, wherein in a side faced to said end, there are provided a ink supply opening for supplying ink to an ink jet recording head and an air vent portion in fluid communication with the ambience; inserting a negative pressure producing member through said opening so as to contact it to the side faced to the opening; inserting a partition wall through said opening so as to be closely contacted to said negative pressure producing member and the container; and closing said opening with a cap member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the drawings.

Figure 1A:
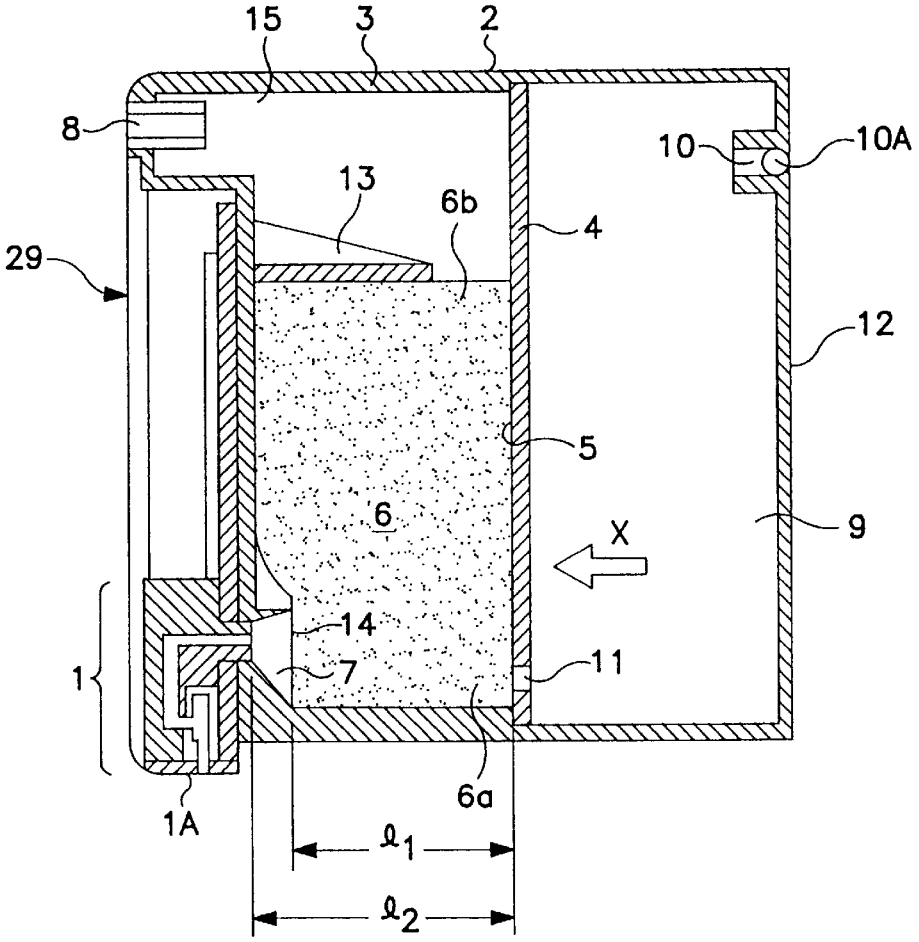
FIG. 1A is a sectional view of an ink jet cartridge according to an embodiment of the present invention.
Figure 1B:
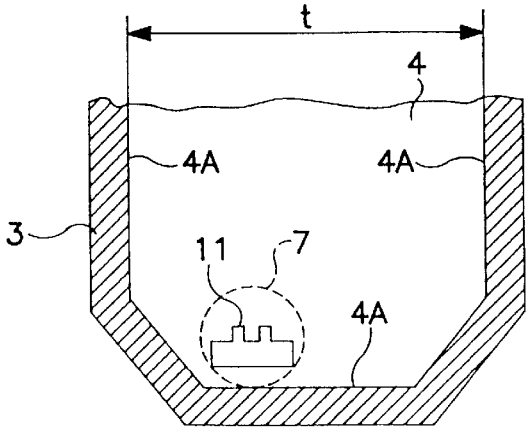
FIG. 1B is a view as seen in X direction in FIG. 1A.

FIG. 1(A) depicts a cross-section of the ink jet cartridge in an embodiment of the present invention, and FIG. 1(B) depicts in enlargement the portion indicated by an arrow mark X, as seen from the direction indicated also by the arrow mark X.

Referring to FIG. 1(A), the ink jet cartridge is separable into an ink jet unit 29 and an ink container portion 2. The ink jet unit 29 comprises an ink jet recording head, and the ink container portion 2 which stores the ink to be supplied to the ink jet unit 29.

The ink container portion 2 is constituted of a main shell 3 and a cover member 12, and a partition wall 4 which divides the ink container portion 2 into a first storage chamber 5 and a second storage chamber 9.

The first storage chamber 5 contains a negative pressure generation member 6, and has an air vent 8 for allowing the atmospheric air to reach the negative pressure generation member 6, and an ink delivery port 7 through which the ink is supplied to an ink jet recording head 1. The ink supply port 7 is provided with-a filter 4 for eliminating the foreign matter from within the ink container portion 2.

An ample air space 15 is provided between the air vent 8 and the negative pressure generation member 6. This air vent space 15 is formed and maintained by a retainer plate 13, which compressively holds the negative pressure generation member 6.

The partition wall 4 has a fine (i.e., small) communicating portion such as a micro-passage 11, which is disposed so as to almost directly oppose the ink delivery port 7. The micro-passage 11 is cut through the partition wall 4, and is disposed away from the joint 4A between the partition wall 4 and the wall of the shell of the container portion (refer to the same drawing).

The second storage chamber 9 is connected to the first storage chamber 5 through the micro-passage 11, and holds only the ink which is to be supplied to the first chamber 5.

The ink is injected into the second storage chamber 9 through an ink injection port 10 of the cover member 12. After the ink is injected, the ink injection port 10 is sealed with a SUS ball 10A in order to prevent the ink leakage from the ink injection port 10.

Next, ink delivery in this embodiment will be described.

As an ink jet recording apparatus is operated, the ink is ejected from the orifices of the ink jet recording head, generating ink drawing force in an ink container IT. The ink is delivered by this drawing force from the second storage chamber 9 (ink storage portion) 9, through the micro-passage 11, to the first storage chamber 5 (negative pressure generation member storage portion). Then, it is further delivered through the negative pressure generation member to the ink delivery port 7, through which it is supplied to the ink jet recording head.

Consequently, the internal pressure of the ink storage chamber which is sealed except for the presence of the micro-passage 11 is reduced, creating pressure difference between the ink storage portion 9 and the negative pressure generation portion 5. As the recording operation further continues, the pressure difference also continues to increase, but since the negative pressure generation member storage portion 5 is open to the atmosphere, air continues to enter the ink storage portion 9 through the negative pressure generation member 6 and the micro-passage 11, cancelling the pressure difference between the ink storage portion 9 and the negative pressure generation member storage portion 5. This process continues while maintaining a certain degree of negative pressure in the ink container, during the recording action of the ink jet recording head. The ink within the ink storage portion can be almost entirely consumed except for the ink adhering to the internal wall surfaces of the ink storage portion. In other words, the usable ink ratio is improved.

With regard to the structure of this ink container portion, it is essential for the ink within the ink storage portion 9 to be reliably delivered to the ink delivery port 7 through the micro-passage 11. Therefore, in the case of the ink jet cartridge structure employed in this embodiment, a region 6*a* of the negative pressure generation member 6, which is located between the ink delivery port 7 and the micro-passage 11, is in a more compressed state than the other region 6*b*.

Next, a description will be given as to the state in which the negative pressure generation member region 6*a* located between the ink delivery port 7 and micro-passage 11 is more compressed than the other region 6*b*.

Figure 4:
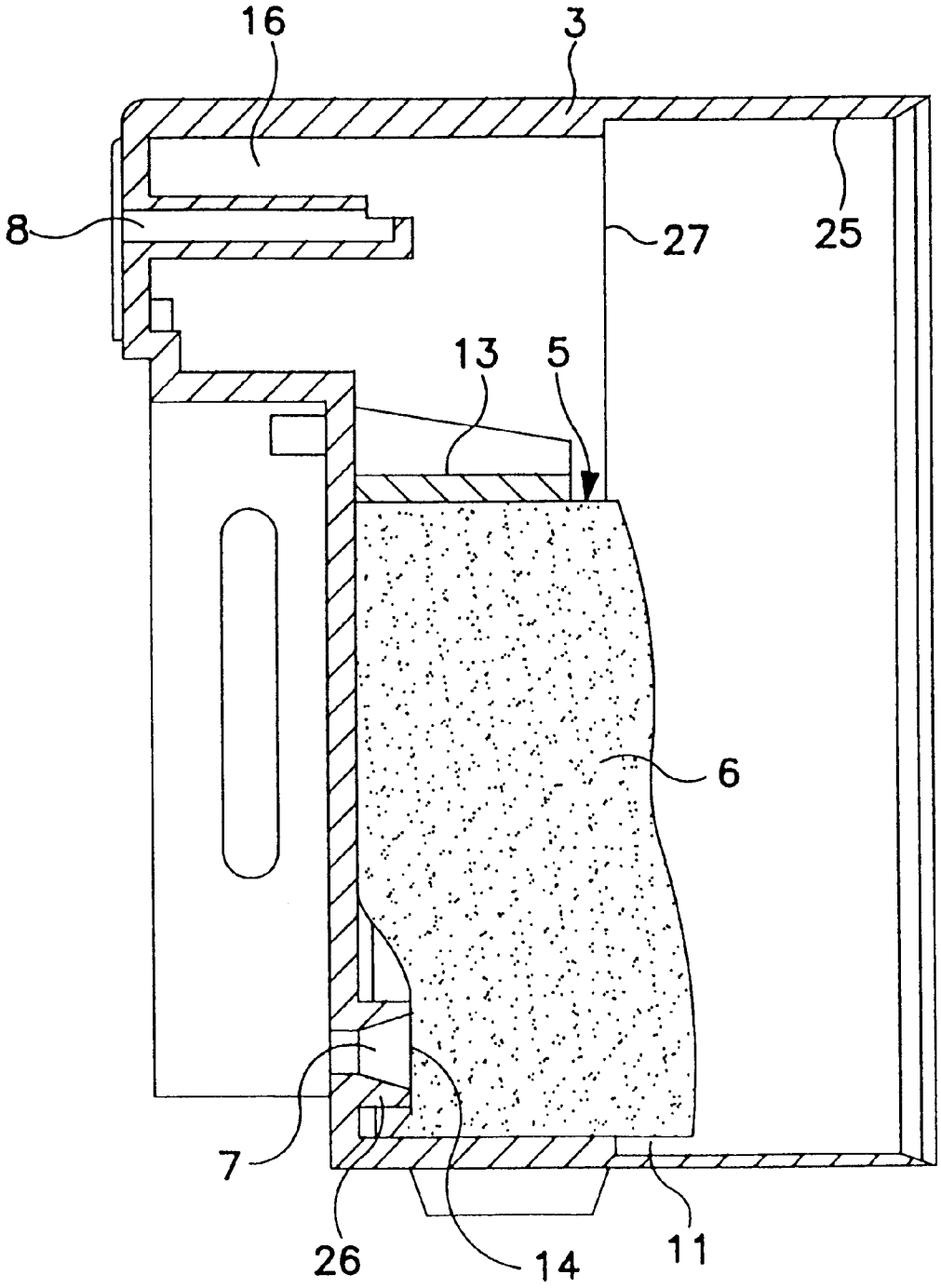
FIG. 4 shows an ink container with a negative pressure producing member contained therein according to an embodiment of the present invention.
Figure 6:
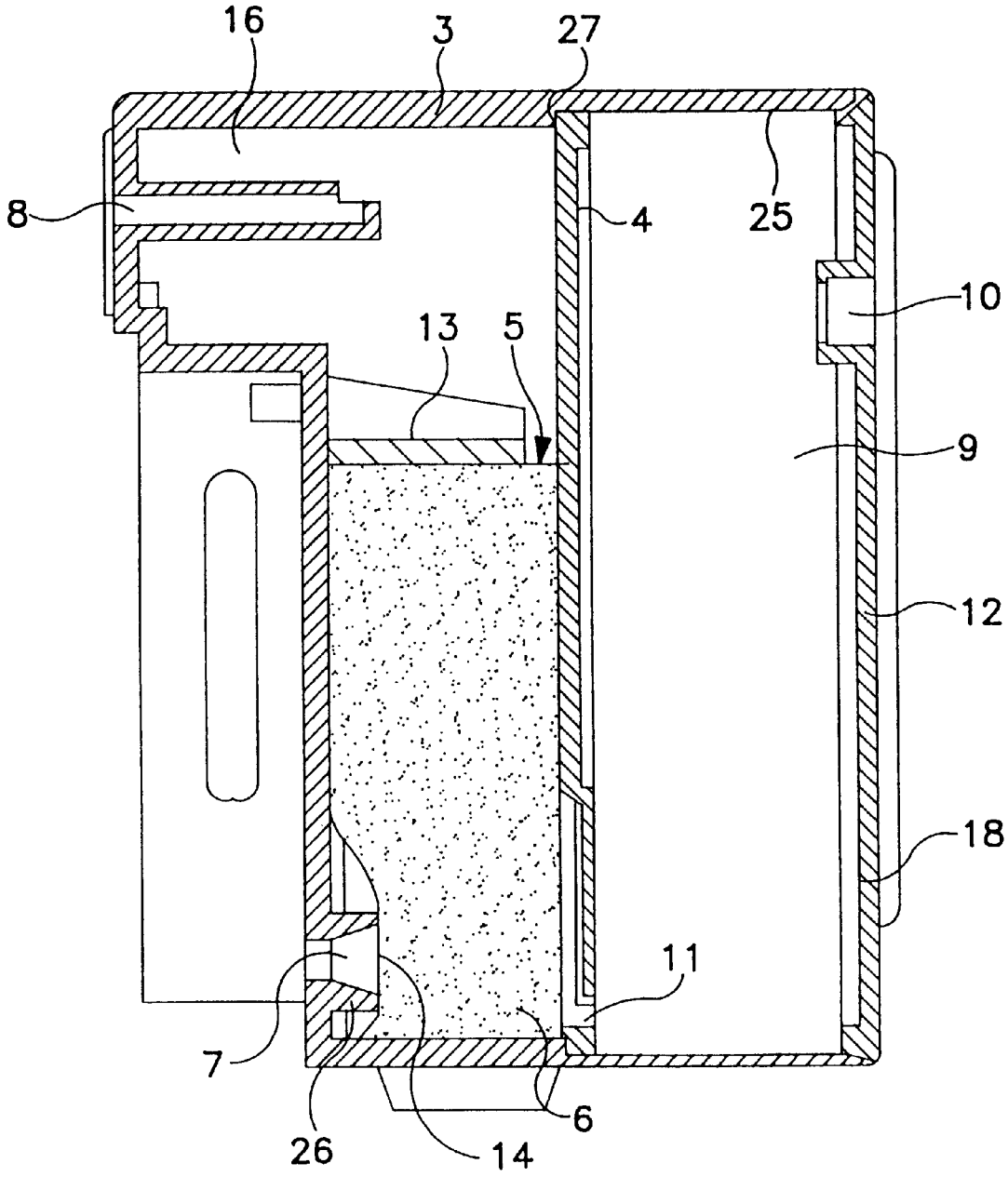
FIG. 6 shows an ink container having a cap member according to an embodiment of the present invention.

Before the placement into the first storage chamber 5, the negative pressure generation member 6 is substantially shaped like a rectangular parallelepiped. It is compressed as it is assembled into the first storage chamber 5 from the opening 25 of the ink container main shell, as shown in FIG. 4. Next, it is further compressed as the partition wall 4 is welded to the ink container main shell to seal in the negative pressure generation member 6 as shown in FIG. 6. As a result, even its bulging portion, that is, the portion opposite to the ink delivery port 7, is compressed into the chamber 5, coming airtightly in contact with the partition wall 4 as do the other portions. Consequently, the region 6*a* sandwiched between the inwardly projecting portion 26 of the ink delivery port 7, and the micro-passage 11 is compressed more than the other region 6*b*, since the micro-passage 11 of the partition wall 4 is located almost directly opposite the projecting portion 26 as shown in FIG. 1(A).

Figure 7:
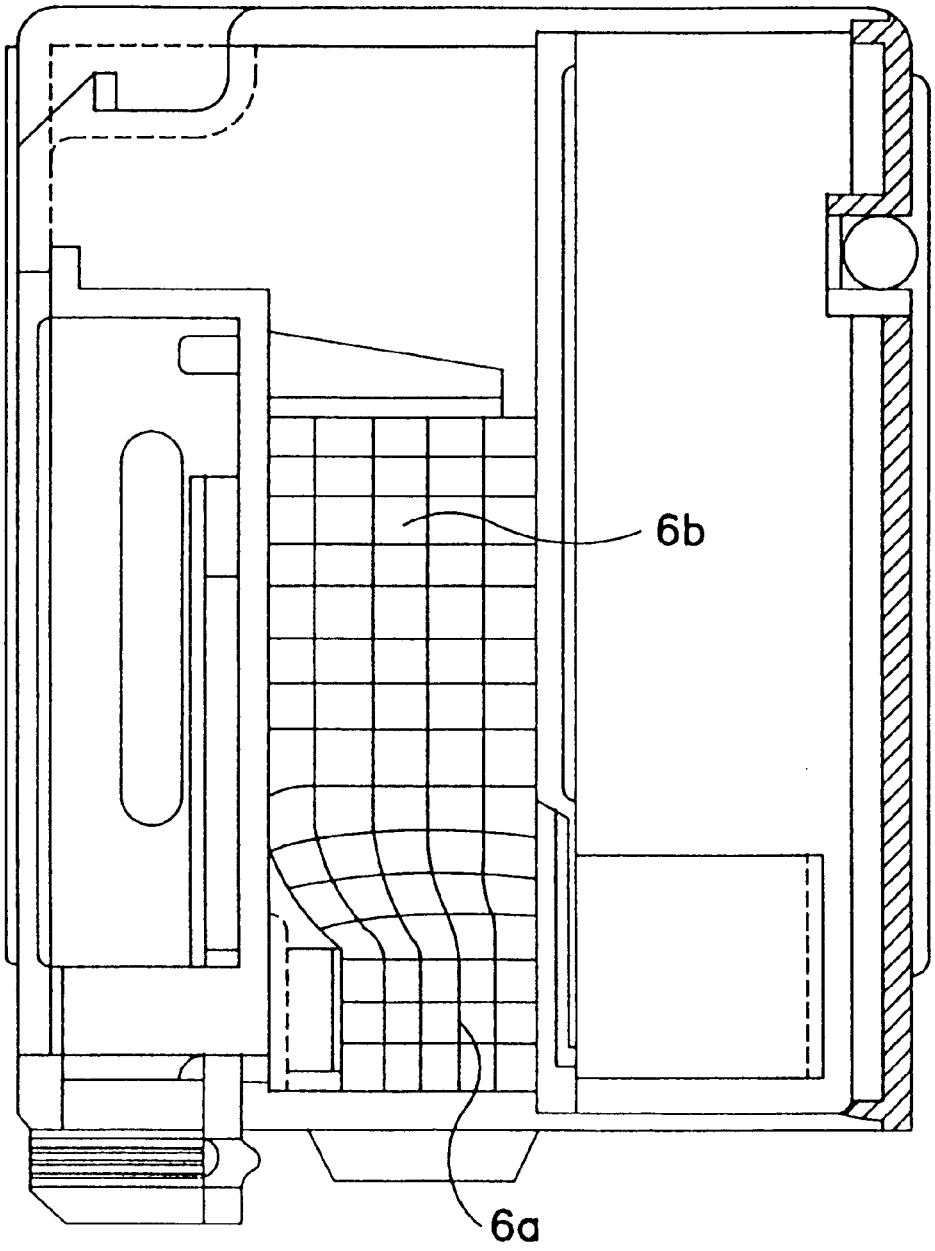
FIG. 7 is a schematic view of an absorbing material in a compressed state.

Therefore, the ink supplied from the ink storage portion 9 directly enters the high compression region 6*a* of the negative pressure generation member 6, which is sandwiched between the micro-passage 11 and ink delivery port 7, being guided straight to the ink delivery port 7. The compressed state of the ink absorbent member is schematically depicted in FIG. 7.

According to the present invention, the region 6*a* of the negative pressure generation member 6, which is located between the micro-passage 11 and ink delivery port 7, is compressed more than the other region 6*b*, and remains compressed in the same state, by the above structure. Therefore, the ink from the second storage chamber 9 is directly introduced into the higher compression region 6*a*, that is, the region with higher capillarity, and then is delivered straight to the ink delivery port 7. As a result, the ink can be reliably supplied from the second storage chamber 9 to the ink delivery port 7 in whatever state the ink container is stocked. In other words, the ink delivery route is reliably maintained regardless of the state of the ink in other region of the negative pressure generation member 6. Further, the filter 14 is disposed on the inward side of the ink delivery port 7, pressing on the negative pressure generation member 6, and therefore, causing the ink to form meniscuses at the surface of the negative pressure generation member 6, which faces the ink delivery port 7. Consequently, in this structure, the filter 14 can more effectively trap the microscopic bubbles, which otherwise are more liable to be passed through from the side of the negative pressure generation member 6, than in the other structures.

Also, a space as a buffer chamber 15 is provided adjacent to the air vent 8 of the first storage chamber 5 in order to prevent contact between the air vent 8 and negative pressure generation member 6, offering an additional advantage in that the ink leakage from the air vent 8 is impeded by the presence of the buffer chamber 15.

Further, according to the structure of this embodiment, the negative pressure generation member 6 does not retain the ink on the air vent side, which also offers an advantage in that the ink within the ink container is prevented from leaking through the air vent 8.

When the ink jet cartridge is in use, this air vent side region of the negative pressure generation member 6 can allow the external air to effectively enter the cartridge as needed, preventing the abnormal pressure change in the ink container. It is preferable that this air vent side region of the negative pressure generation member 6 is such a region that is never wetted by the ink. This is because a region, which has never been wetted, can further slow down the permeation speed of the ink itself. However, the region may be creating by removing the ink from the ink wetted portion.

Needless to say, even the ink container 3 with the mandatory structure of the present invention comes in contact with the operator's fingers. Normally, such contact causes no problem, but when the pressure generated by such contact exceeds a certain level, the ink storage chamber 9 storing nothing but the ink is liable to be deformed, although this depends on the size of the ink chamber 9. As for the structure for eliminating this problem caused by the external pressure, it is preferable that additional partition walls (unillustrated) with a larger passage than the micro-passage 11 of the partition wall 4 between the first and second storage chambers 5 and 9 are disposed within the second storage chamber 9. Further, from the standpoint of the deformation, when the cartridge is formed of resin material, it is preferable and more practical that the wall thickness Ti of the ink only chamber is no less than 0.8 mm, and the wall thickness of the storage chamber for accommodating sponge or the like material as the negative pressure generating member is no less than 1.3 mm. Further, it is more preferable and practical that the wall thickness Ts is in a range of no less than 1.2 times but no more than 3.0 times the wall thickness Ti.

In this embodiment, the compression ratio of the absorbent material contained in the storage chamber 5 is set at approximately 4.5, except for the high compression region, that is, the region 6*b* located between the ink delivery port 7 and partition wall 4. In the high compression region 6*b*, the compression ration becomes approximately 6.3 because of the presence of the inwardly projecting portion 26 of the ink delivery port 7.

Referring to FIG. 1(A) illustrating the above structure, a length 12 of the absorbent material chamber is approximately 14 mm; the distance 11 between the inwardly projecting portion of the ink delivery port and the partition wall is approximately 10 mm; and the depth, illustrated in FIG. 1(B), of the absorbent material chamber is approximately 22 mm.

The inventors of the present invention constructed a test model of an ink container with the same structure as the one illustrated in FIG. 1, which is approximately 15 mm in the length 12 of the absorbent material chamber, and approximately 10 mm in the distance 11 from inwardly projecting portion of the ink delivery port to the partition wall. Also in this test model, the high compression region, which the inventors intended to form, could be created, enabling the ink to be stably supplied from the ink storage chamber to the ink delivery port.

The relationship between the length 12 of the absorbent material chamber, and the distance 11 between the inwardly projecting portion of the ink delivery port and the partition wall, is one of essential factors in the creation of the region 6*a* as the high compression region. When the distance between the ink delivery port and partition wall is too long, there is the possibility that a state of a desirable high rate of compression cannot be created in the region 6*a*. On the contrary, when the distance between the inwardly projecting portion of the ink delivery port and the partition wall is too short relative to the length of the absorbent member chamber, there is the possibility that the ink cannot be sufficiently delivered even though the state of high compression can be created in the region 6*a*.

The relation between the length 12 and the depth t, of the absorbent material chamber, is also one of the essential factors. When the depth t is too small relative to the length 12, the compression ratio in the depth direction is uniformly increased, making it rather difficult to create the high compression region.

Therefore, in order to make it easier to create the state of high compression in the region 6*a*, it is preferable that the ratio of the distance between the inwardly projecting portion of the ink delivery port and the partition wall to the length of the absorbent material chamber is in a range of no less than ⅔ but no more than ¾, and the depth of the absorbent material chamber is more than the length thereof.

Referring to FIG. 1(B), the micro-passage 11 is located away from the wall-surface of the container main shell 3. This is due to the following reason.

In the case in which the micro-passage of an ink jet cartridge is located in contact with the internal wall surface of the container main shell 3, and such an ink jet cartridge is left stationary, being positioned to cause the micro-passage side to be on top, during its distribution or the like in the market, the ink within the second storage chamber 9 is continuously drawn up to the micro-passage 11 by the capillarity, along the joint 4A at which the internal wall surface of the container main shell 3 and the partition wall 4 intersect, and then is absorbed by the negative pressure generation member 6 in the first chamber 5. Eventually, it comes to a point beyond which the negative pressure generation member 6 is saturated with the incoming ink, and an excessive amount of the ink collects around the air vent 8. Therefore, there is the possibility that the ink could leak out from the air vent. In this embodiment, however, the micro-passage 11 is located away from the internal wall surface of the container main shell; therefore, even when the ink jet cartridge is left in the stationary state, in which the micro-passage 11 remains on top, the ink within the second chamber 9 can be prevented from being drawn along the joint 4A by the capillarity, and entering the first chamber 5 through the micro-passage 11. Further, a buffer space 15 of a sufficient size is provided in front of the air vent 8; therefore, even when the ink successfully enters the first chamber because of the aforementioned reason, or changes of the environmental condition under which the ink jet cartridge is used, the ink is prevented from leaking out.

Figure 2A:
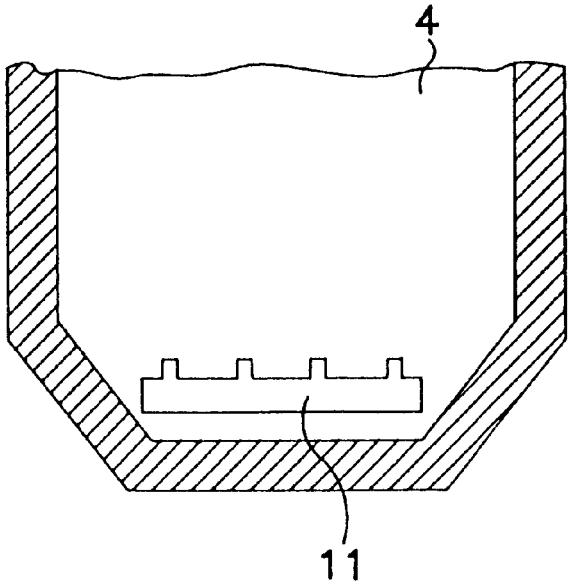
FIGS. 2(A) and 2(B) show an example of the configuration of a fine communicating portion according to an embodiment of the present invention.
Figure 2B:
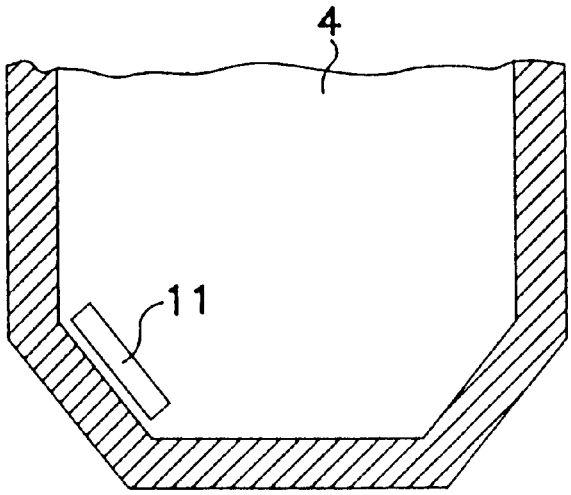

FIGS. 2(A) and 2(B) depict another structure of the micro-passage 11 in accordance with the present invention. Its configuration and measurement are not limited to those illustrated in FIG. 2. What is essential is that the micro-passage 11 of the partition wall 4 is located away from the joint 4A as described before. Also regarding the micro-passage 11, when its cross-section is excessively small, the ink meniscus force becomes too strong to allow a sufficient amount of the ink to be delivered from the second chamber 9 to the first chamber 5, threatening to interrupt the ink supply in the middle of the ink ejection from a recording head 1. On the contrary, when the cross-section is excessively large, it tends to cause a phenomenon opposite to the ink supply interruption. Therefore, it is preferable that the height of the micro-passage 11 is more than the average pore diameter of the negative pressure generation member 6 (preferably, the average pore diameter adjacent to the micro-passage 11); it is preferable in terms of practicality that it is no less than 0.1 mm and no more than 5.0 mm. However, the optimum cross-section measurement of the micro-passage 11 for the ink supply stabilization is no more than 3.0 mm.

As for the material for the ink cartridge IJC in this embodiment, it may be any material which has been used for forming the conventional ink cartridge, but it is important to select the material which does not affect the ink jet ink, or components which have been treated so that they do not affect the ink jet ink. Further, when transparent or translucent resin material is selected to form the container main shell 3, the ink within the first and second chambers 5 and 9 can be seen from outside the ink cartridge, allowing an operator to visually determine the ink cartridge exchange timing.

The ink container IT comprises a container main shell 3, a negative pressure generation member 6, a partition wall 4, a cover member 12, and an SUS ball 10A. The partition wall 4 has a micro-passage 11, which connects a chamber 5 for the negative pressure generation member 6, and an ink chamber 9. The SUS ball 10A seals the ink chamber after the ink is injected. This ink container is assembled through the following steps.

Referring to FIG. 4, first, the negative pressure generation member 6 is compressed into the chamber 5 through the opening of the ink container main shell 3. It should be noted here that the negative pressure generating member 6 to be compressed into the chamber 5 in this step may be a precompressed one, or a non-compressed one. In either case, the ink delivery port 7 side of the negative pressure generation member 6 is pushed back by the inwardly projecting portion 26 of an ink delivery port 7, bulging toward the wall with the opening 25 relative to the other region of the negative pressure generation member 6. A reference numeral 27 designates a welding line at which the partition wall 4 is welded to partition the container main shell 3 into the negative pressure generation member chamber 5 and ink chamber 9. In this embodiment, a step is formed at the welding line 27 to allow the partition wall 4 to be easily fixed to a predetermined location. In order to improve the state of airtightness between the negative pressure generation member 6 and partition wall 4, it is desirable that the negative pressure generation member 6 is shaped to slightly bulge toward the wall with the opening 25, relative to the welding line 27. A reference numeral 13 designates a pressing member, which functions to guide the negative pressure generation member 6 to settle at a predetermined location.

Figure 5:
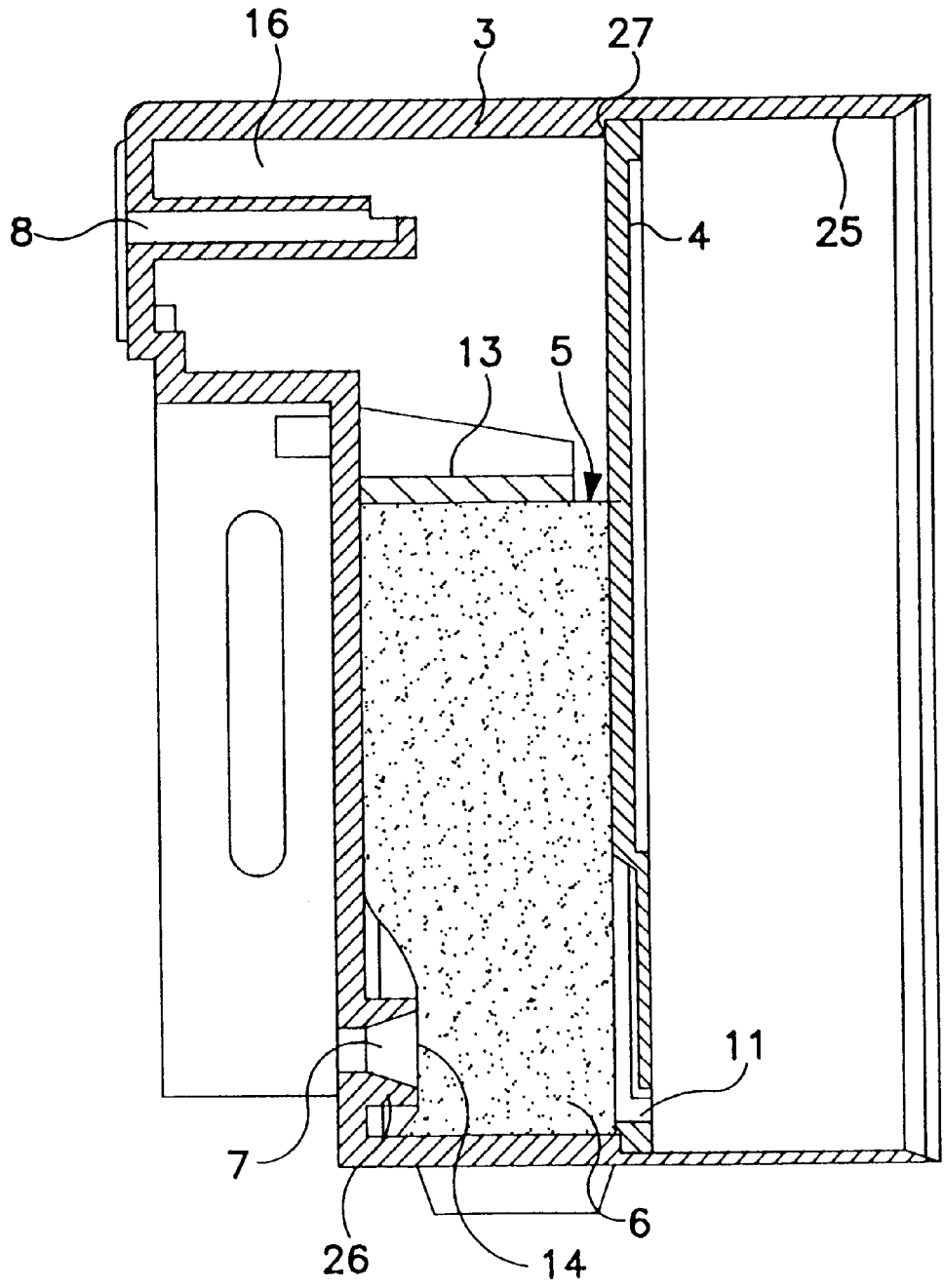
FIG. 5 shows an ink container having a partition wall according to an embodiment of the present invention.

Referring to FIG. 5, the partition wall 4 is inserted also from the side of the opening 25 of the container main shell 3, and is continuously welded to the container main shell at the welding line, forming the aforementioned two chambers, which are completely sealed from each other except for the presence of the micro-passage 11. During this welding step, the bulge of the negative pressure generation member 6 on the side of the ink delivery port 7 is also compressed so that it makes the same airtight contact with the partition wall 4 as the other region.

Figure 9A:
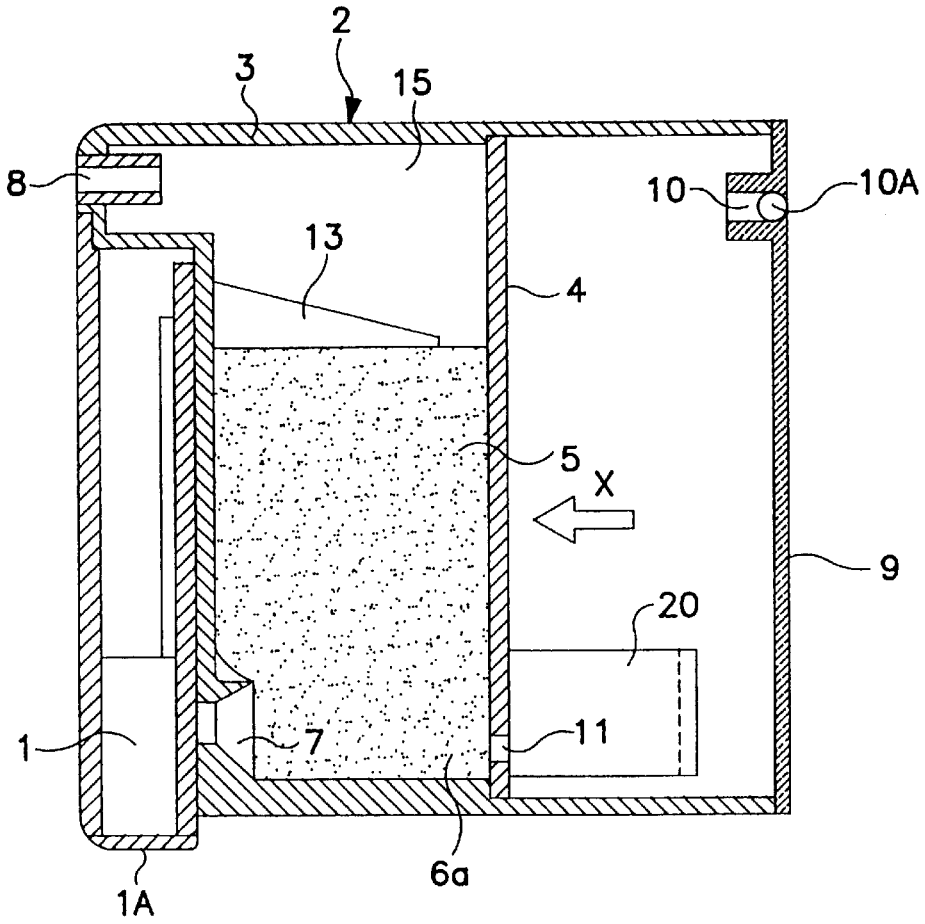
FIGS. 9(A) and 9(B) show an ink container according to a further embodiment of the present invention.
Figure 9B:
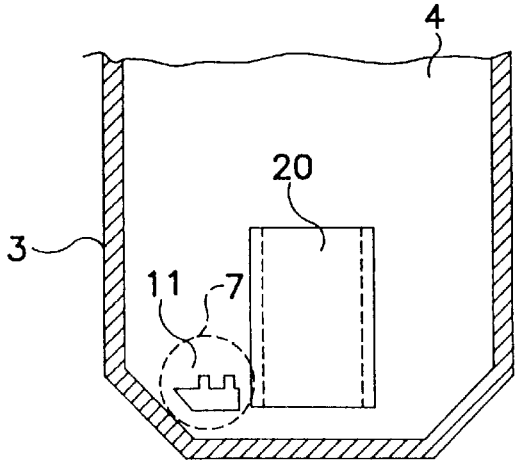

Next, referring to FIG. 6, the cover member 12 and container main shell 3 are completely sealed to each other using ultra-sonic welding or the like. Thereafter, the ink is injected through the ink injection port 10 of the cover member 12. Then, the SUS ball 10A is pressed into the cover member 12 as shown in FIGS. 9(A) and 9(B), completely sealing the ink chamber 9 (which will be described later), except for the presence of the micro-passage 11.

It is preferable that the negative pressure generation member 6 makes uniform and airtight contact with the internal wall surface of the container main shell 3 as well as the partition wall 4 with the micro-passage 11.

Next, referring to FIGS. 3 and 11, descriptions will be given of the structures of the ink jet unit IJU, the ink cartridge IJC, and the ink jet recording apparatus employing the IJC to record images, which are in accordance with the present invention.

Figure 3A:
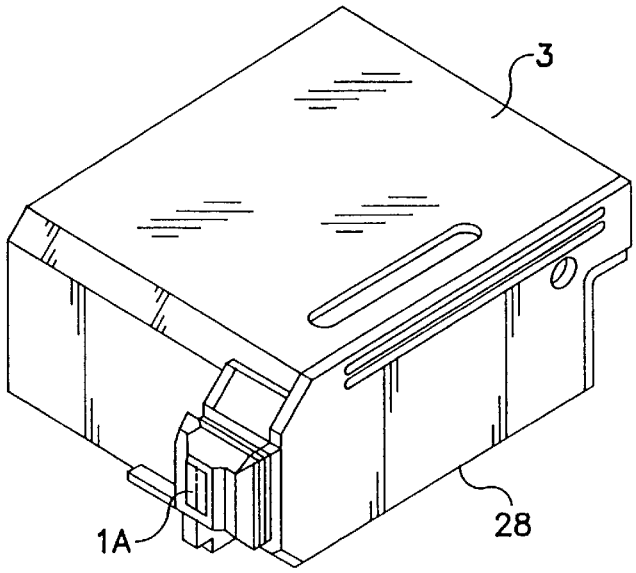
FIGS. 3(A) and 3(B) show an outer appearance of the ink jet cartridge according to an embodiment of the present invention.

As is evident from the perspective view in FIG. 3(A), the ink jet cartridge IJC in this embodiment is of a type with an increased ink space ratio. The tip of the ink jet unit IJU slightly projects from the front surface of the ink container IT.

Figure 3B:
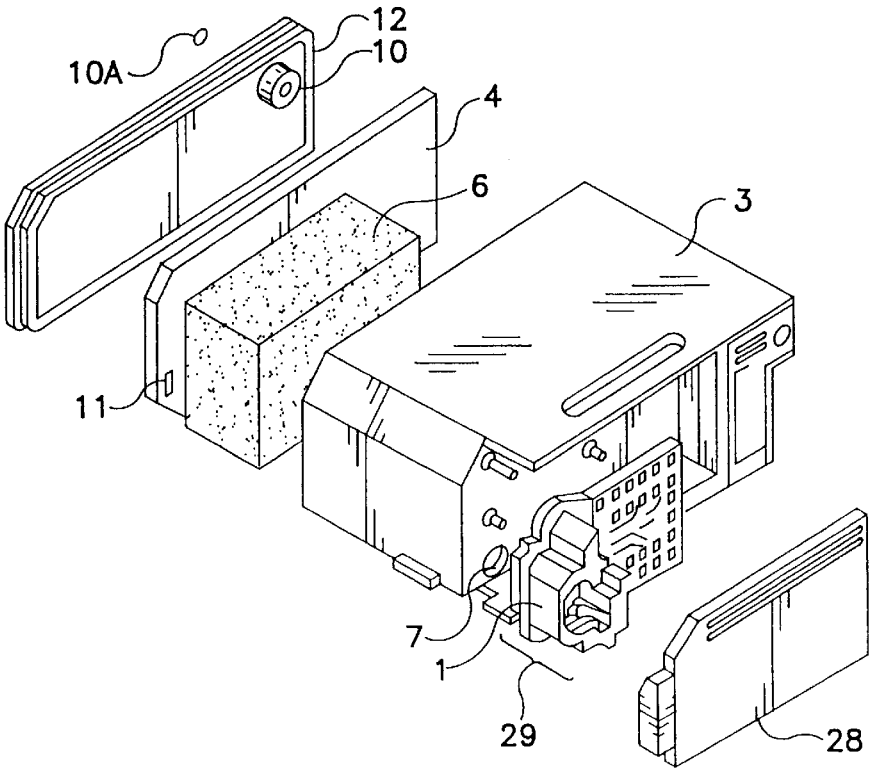

Referring to FIG. 3(B), the ink jet cartridge of this embodiment comprises a cover member 12, an SUS ball 10A for sealing an ink injection port 10, a partition wall 4 with a micro-passage 11, a container main shell 3 for housing a negative pressure generation member 6 and holding the ink, an ink jet unit (IJU) 29, and a head cover 28 for protecting the ink jet unit (IJU). The ink jet unit (IJU) delivers the ink to an ink jet recording head 1 from the ink delivery port 7 of the container main shell 3, through a joint pipe (unillustrated), and also transmits printing signals from the main assembly of an ink jet recording apparatus IJRA. In the drawing, a negative pressure generation member 6 is depicted in the compressed state. This compressed state of the negative pressure generation member 6 may be realized by pre-compressing the negative-pressure generation member 6 to a predetermined compression ratio before its placement in the container main shell 3, or may be realized as the negative pressure generation member 6 is assembled into the container main shell 3, as described previously.

This ink jet cartridge IJC is of an exchangeable type, and is mounted on the carriage HC of the main assembly of the ink jet recording apparatus IJRA, wherein its position is fixed by an unillustrated positioning means of the carriage HC, and an electrical contact point.

As for the ink jet unit IJU 29, it is of a type which effects recording by employing electrothermal transducers which generate thermal energy for triggering film boiling of the ink in response to electrical signals.

Figure 11:
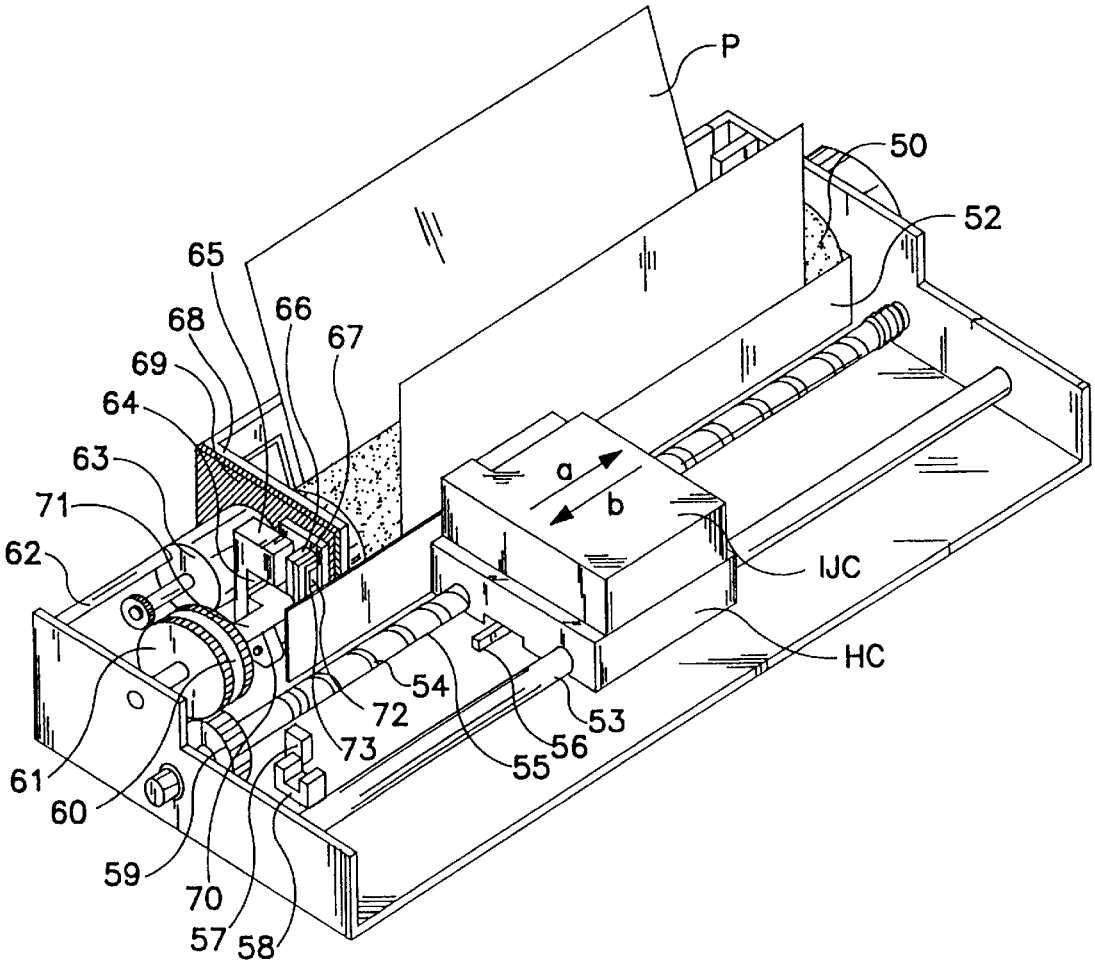
FIG. 11 shows a printer to which the ink jet cartridge according to an embodiment of the present invention is mounted.

Referring to FIG. 11, which is an external perspective view of a typical ink jet recording apparatus IJRA, to which the present invention is applicable, the carriage HC has a pin (unillustrated), and this pin is engaged in the spiral groove 54 of a lead screw 55. As the lead screw 55 is rotated forward or backward by the forward or backward rotation of a driving motor 63 through driving force transmission gears 61 and 59, the carriage HC is reciprocated in the direction of arrow mark a or b. A reference numeral 52 designates a sheet holder plate, which presses a recording sheet onto a platen 50 across the entire reciprocating range of the carriage HC. Reference numerals 57 and 58 designate photocouplers as means for detecting the presence of a carriage lever 56, the detection of which switches the rotational direction of the motor 6. A reference numeral 66 designates a member for supporting a capping member 72 which caps the face of the recording head, and a reference numeral 56 designates vacuuming means for vacuuming the interior of the capping member 72. It restores the recording head performance by suction generated through the opening 73 of the capping member 72. A reference numeral 67 designates a cleaning blade, and a reference numeral 69 designates a member which enables the blade 67 to move forward or backward. Both members are supported by the supporting plate 68 of the main assembly. Needless to say, this embodiment is compatible with any known blade besides the blade of this embodiment. A reference numeral 62 designates a lever for initiating the recording head performance restoring suction. It moves as a cam 70 engaged with the carriage moves; its movement is controlled by well-known transmitting means such as a clutch.

The structural arrangements for capping, cleaning, performance restoring vacuuming operations are such that appropriate operations can be triggered at appropriate locations by the function of the lead screw 55 when the carriage in the home position range. Here again, it is obvious that the present invention is compatible with any structural arrangement beside the above structural arrangement, as long as the appropriate operations can be carried out at the well-known timings.

Next, another embodiment of the present invention will be described.

Figure 8A:
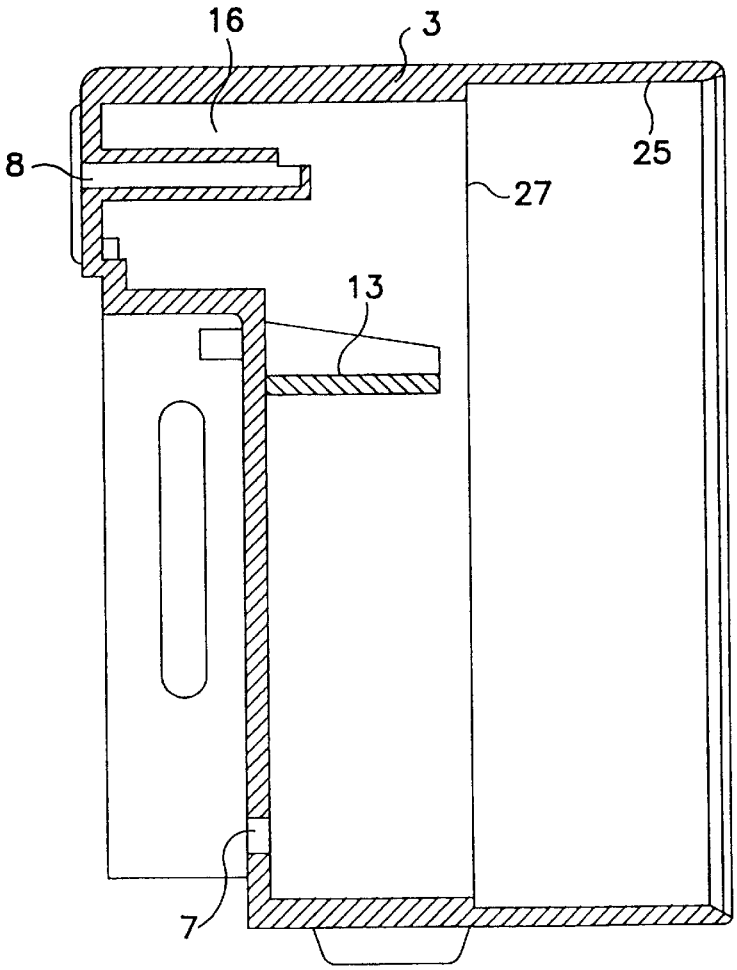
FIGS. 8(A) and 8(B) show an ink container according to another embodiment of the present invention.
Figure 8B:
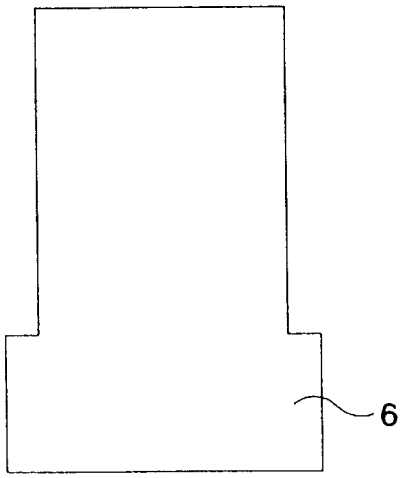

FIGS. 8(A) and 8(B) depict an embodiment of the present invention, in which the shape of the negative pressure generation member 6 is different from that in the preceding embodiment; the measurement of the negative pressure generation member 6 is increased on the side of the micro-passage 11, relative to the rest, as shown in FIG. 8(B). Also with this arrangement, the region sandwiched between the ink delivery port 7 and the micro-passage 11 is compressed to a higher ratio than the rest by the partition wall 4; therefore, the ink directly enters the high compression region through the micro-passage 11, and is guided straight to the ink delivery port 7.

FIGS. 8(A) and 8(B) depict the configuration, in which the ink delivery port 7 does not protrude into the negative pressure generation member chamber 5.

However, it is obvious that the shape of the negative pressure generation member 6 in this embodiment may be employed in conjunction with the inwardly protruding ink delivery port 7 of the preceding embodiment in order to further increase the compression ratio of the negative pressure generation member 6.

Further, as a modification of the structural arrangement for the inwardly projecting ink delivery port 7, a member constituting the ink delivery portion may be inserted to the ink container so that the tip of this member projects inward.

Further, the configuration of the negative pressure generation member 6 is not limited by that illustrated in FIGS. 8(A) and 8(B). It may be any configuration, for example, a trapezoid, as long as the aforementioned region can be compressed to a higher ratio than the rest.

Figure 10:
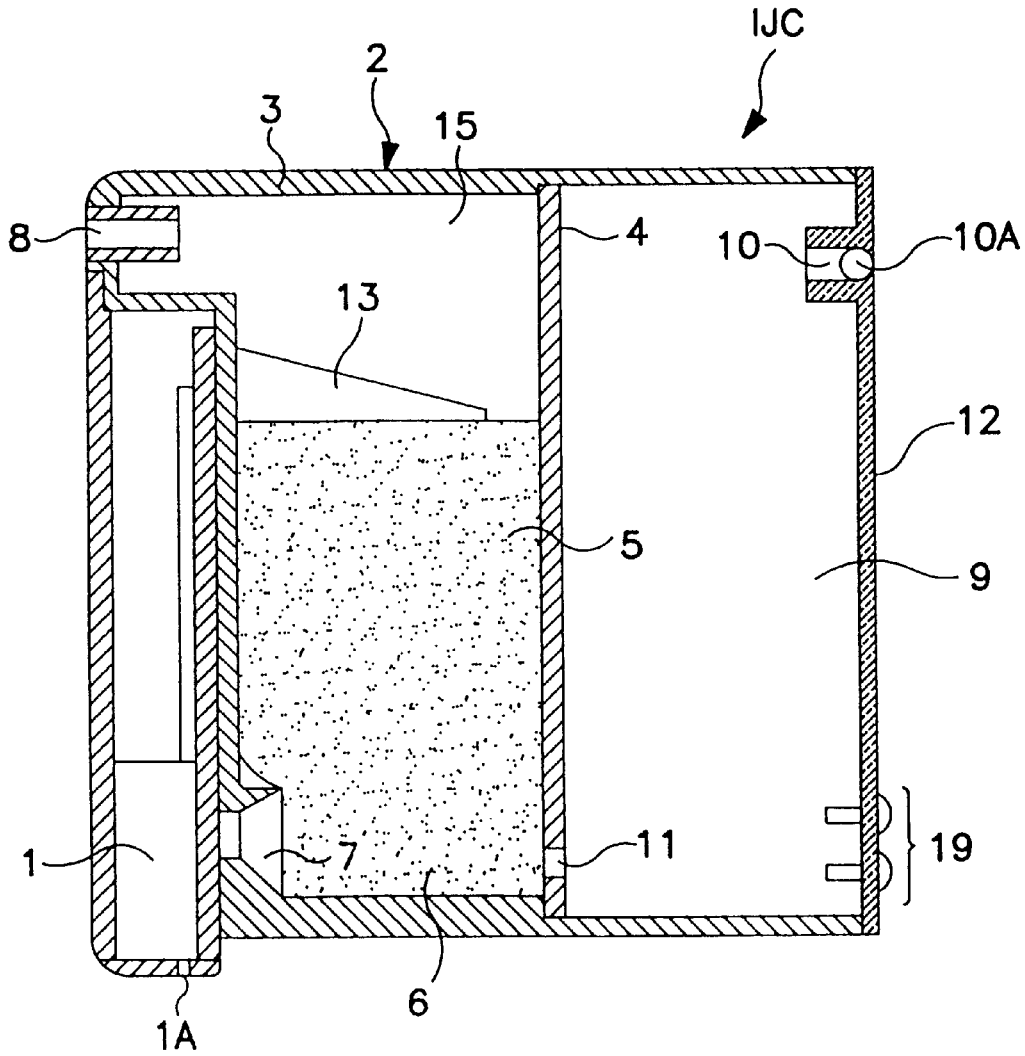
FIG. 10 shows an ink container according to a further embodiment of the present invention.

FIGS. 9(A) and 9(B) depicts the structure of the IJC in the third embodiment of the present invention. The basic structure of the IJC in this embodiment is not different from that illustrated in FIG. 1. In this embodiment, however, the cover member 12 is formed of transparent, ink resistant plastic material such as acrylic resin. Also, a reflective plate 20 for optically detecting the presence of ink is provided as ink reserve detecting means in the bottom portion of the second chamber 9, in conjunction with an unillustrated optical sensor. The optical sensor comprises a light emission element and a light reception element, and is disposed on the carriage HC, for example, of the recording apparatus (printer). When the ink supply in the second chamber 9 is depleted, the light emitted from the light emission element is transmitted through the transparent cover member 12 and the second chamber 9, and is reflected by the reflective plate 20. Then, the reflected light is received by the light reception element, detecting the state of ink depletion. In this embodiment, the reflective plate 20 is provided in the second chamber 9 to detect the presence or absence of the ink supply in the second chamber 9 (whether or not the amount of the remaining ink is above a predetermined level) by the reflection type optical sensor, but instead of the provision of the reflective plate 20, a well-known system in which the presence or absence of the ink is detected by a transmission type optical sensor may be employed. Further, at least a pair of electrodes 19 may be disposed adjacent to the bottom of the second chamber 9 as shown in FIG. 10. In this case, as long as the ink is between the two electrodes 19, they remain electrically connected, but as the ink supply is depleted, they becomes electrically disconnected; absence of the ink is detected due to the change in electrical resistance.

With the provision of the ink reserve detection system as described above, a user can be aware that the ink reserve is running short before the ink supply in the ink container is completely depleted. Thus, in the case of a facsimile machine employing an ink jet cartridge comprising this type of ink container, the situation in which the received information cannot be outputted due to ink depletion can be prevented using an inexpensive means.

Next, ink filling methods, and the general structures related thereto, will be described.

Figure 12:
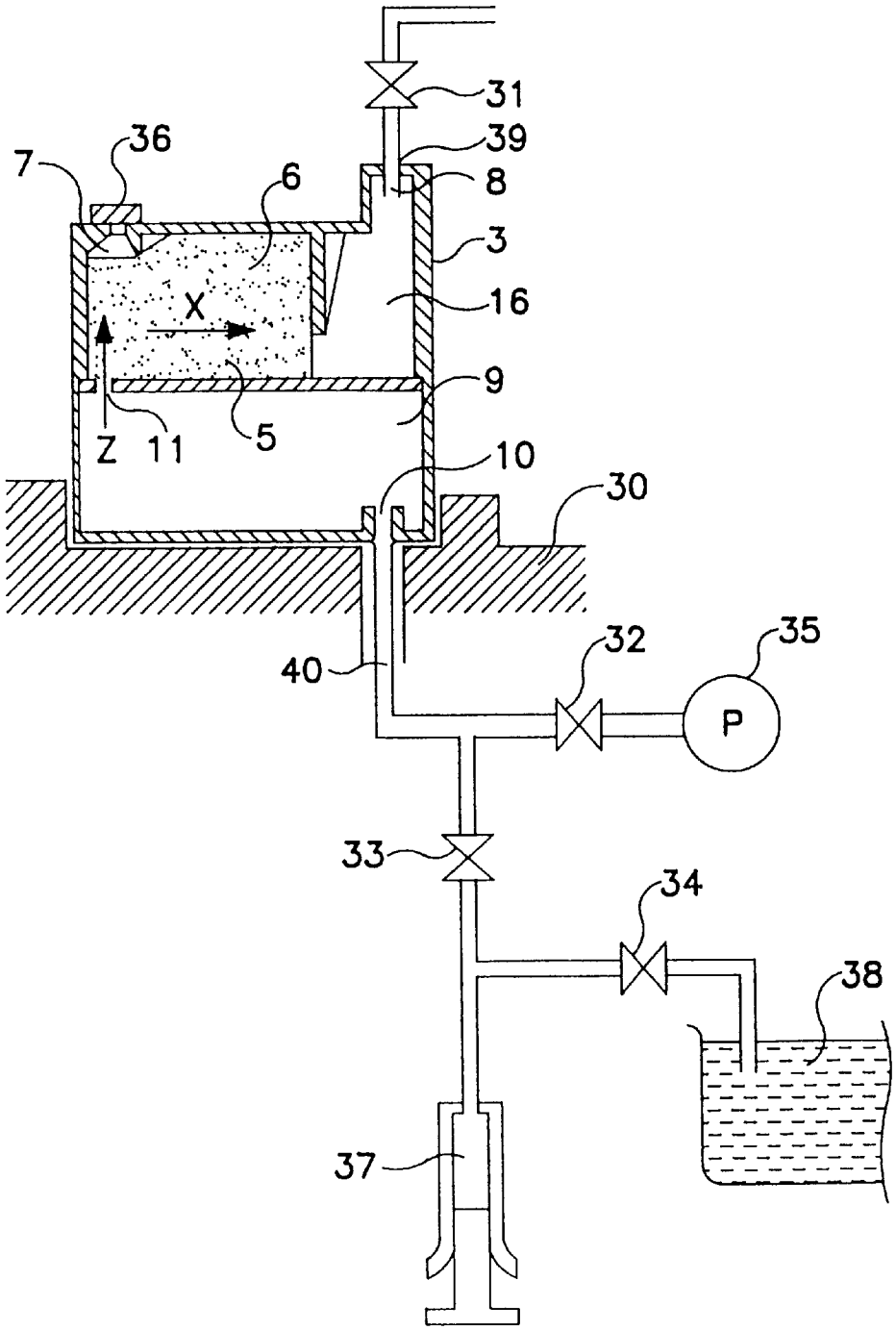
FIG. 12 shows an ink container manufacturing device according to an embodiment of the present invention.

In the above embodiments of the present invention, the ink container is filled with ink using a pressure reducing method. FIG. 12 depicts the structure of the apparatus in accordance with the present invention, which is used for injecting the ink into the ink container in accordance with the present invention, following the ink injection steps in accordance with the present invention.

The container 3 is set in a jig 30; the air vent 8 is connected to an air vent nozzle 39; the ink delivery port 7 is sealed with a plug 36; and a vacuuming/injecting nozzle 40 is connected to the ink injection port 10. First, with the valves A31 and C33 being closed, and valves B32 and D34 being open, the ink is filled into an injector 37 while the container is vacuumed by a pump 35. After the injector 37 is exactly filled with a predetermined amount of ink, the valve 34 is closed. Then, the-valve B32 is closed after the container 35 is vacuumed to a predetermined level.

Next, the valve C33 is opened to allow the predetermined amount of ink to be injected into the container 3 from the ink injector 37. As soon as the injection of the predetermined amount of ink is completed, the valve C33 is closed, and then, the valve A31 is opened to cancel the negative pressure remaining in the container. In other words, the operational sequence from the step in which the ink is injected into the container 3 to the step in which the valve D34 is opened to cancel the residual negative pressure in the container is carried out in a substantially continuous manner. This continuity is to prevent the ink from being drawn into the buffer space 15 by the force which acts to establish a state of equilibrium in the container.

After the above steps are completed, the container is sealed again by closing the valve A31. Then, the vacuuming/injecting nozzle 40 is removed from the ink injection port 10, and the ink injection port 10 is sealed with the SUS ball 10A. Next, the air vent nozzle 39 and the plug 36 are removed from the air vent 8 and the ink delivery port 7, respectively, and the container is separated from the jig 30, completing thereby the ink injecting steps based on the vacuuming method.

When the ink is injected using the vacuum as described above, the ink flow is not affected by the gravity or the density of the ink absorbent member, advancing first in the direction of an arrow mark Z, and then in the direction of an arrow mark X. As a result, the ink is allowed to easily and fully permeate into the negative pressure generation member 6, even into the region sandwiched between the ink delivery port 7 and the micro-passage 11.

Normally, in order to improve printing quality, for example, in order to make the characters printed in black ink sharp and clearly visible, it is preferable to employ an ink, the components of which do not includes surfactant.

Injecting this type of ink using the conventional method, that is, a pressurizing method, results in a problem in that a sufficient amount of ink is not supplied to where the ink is needed. This is because the pressuring method cannot provide sufficient force to enable the ink to fully permeate the negative pressure generation member 6.

More specifically, before the ink injection, the negative pressure generation member is filled with air instead of the ink, and therefore, the high compression region of the negative pressure generation member generates higher resistance to the ink flow than the rest. That is, in the case of the ink injection by the pressurizing method, the ink is not allowed to fully permeate into the high compression region of the negative pressure generation member, that is, the region 6*a* sandwiched between the micro-passage 11 and the ink delivery port 7, due to the presence of this flow resistance difference. Therefore, the ink is liable to permeate by a disproportional amount into the region 6*b* in which the compression ratio is smaller than in the region 6*a*.

As a result, the ink injection process will end with air bubbles still remaining in the high compression region 6*a* of the negative pressure generation member 6; therefore, when the ink moves from the ink chamber 9 to the ink delivery port 7, the air bubbles in the negative pressure generation member 6 create higher flow resistance, being liable to impede stable ink delivery.

The employment of the aforementioned vacuuming method, however, is not affected by the gravity, or the density of the ink absorbent material; therefore, even when the ink which contains no surfactant, that is, the ink with a low level of permeative power, is used, the ink can be easily and fully injected into where it is needed, that is, the high compression region 6*a* of the negative pressure generation member 6, which is sandwiched between the micro-passage 11 and the ink delivery port 7. This is because the air contained in the negative pressure generation member 6 is removed as the container is vacuumed before the ink injection, reducing the ink flow resistance difference between the two regions to an negligible level.

Thus, according to the present invention, the ink can be reliably retained in the container, as described above, due to the higher ink retaining power of the high compression region 6*a* of the negative pressure generation member 6 than that of the other region 6*b*, regardless of ink container orientation, whether it is left stationary in a storage, or carried around for distribution. Further, the ink injection by the vacuuming method is different from that by the pressurizing method in that the high compression region 6*a* can be filled with the ink without leaving air bubbles; therefore, the ink flow resistance is reduced to allow the ink to be stably supplied from the ink chamber 9 to the ink delivery port 7.

Further, the ink within the ink chamber is drawn through the micro-passage, and straight into the high compression region of the negative pressure generation member, and this high compression region is directly connected to the ink delivery port; therefore, the ink retained in the region sandwiched between the ink chamber and the ink delivery port does not move out, preventing thereby the air from moving into this region. Thus, the ink container and the ink jet cartridge, which offer superb ink delivery performance, can be provided.

Further, in the case of the ink cartridge in accordance with the present invention, the micro-passage is cut through the partition wall, being located away from the air vent, and at the same time, being not located along the internal wall surface of the second chamber. In other words, according to the present invention, an ink jet cartridge capable of reliably retaining the ink regardless of its orientation can be realized by the provision of a simple structure.

Further, an ink jet recording apparatus capable of reliably delivering ink from an ink jet cartridge to a recording head can be provided.

Further, with the employment of the manufacturing method in accordance with the present invention, the aforementioned ink cartridge with the simple structure can be easily manufactured, and also, ink can be reliably injected into a thus manufactured ink container with the simple structure, without being affected by the gravity, or the density of the absorbent material.

While the invention has been described with reference to the structures disclosed herein, it is not confined to the details set forth, and this application is intended to cover such modifications or changes as may come within the purposes of the improvements or the scope of the following claims.

What is claimed is:

1. An ink container connectable with an ink jet head detachably mountable to an ink jet device, said ink container comprising:

a container body;

a partition wall dividing an inside of said body into a first accommodating chamber and a second accommodating chamber;

wherein said first accommodating chamber contains a negative pressure producing member and is provided with an ink supply opening connectable with said ink jet head to supply ink and an air vent portion for communication with ambience, said ink supply opening being formed in a wall faced to said partition wall, a portion defining said ink supply opening being projected inwardly of said first accommodating chamber;

wherein said second accommodating chamber is provided with ink;

wherein said partition wall defines a communicating portion opposed to said ink supply opening, said communicating portion for permitting movement of the ink from said second accommodating chamber to said first accommodating chamber and movement of air from said first accommodating chamber to said second accommodating chamber, and wherein said partition wall is provided with a groove extended from said communicating portion to a point away from an end of said partition wall remote from said communicating portion, said groove facilitating movement of the ink from said second accommodating chamber to said first accommodating chamber and the movement of air from said first accommodating chamber to said second accommodating chamber;

wherein a first portion of said negative pressure producing member that is between said ink supply opening and said communicating portion has a uniformly compressed region in which said negative pressure producing member is uniformly compressed at a compression ratio more than that of portions other than said first portion; and wherein in such a region of said negative pressure producing member as is adjacent to said first portion and as is between said groove and a wall opposed thereto, there is a non-uniformly compressed region in which said negative pressure producing member is non-uniformly compressed.

2. An ink container according to claim 1, wherein a ratio between a length from said partition wall to the inward projected portion and a length from said partition wall to a region of said first accommodating chamber not having said ink supply opening, is ⅔ to ¾.

3. An ink container according to claim 2, wherein a depth of said container is longer than a length from said partition wall to said region of said first accommodating chamber not having said ink supply opening.

4. An ink container according to claim 1, wherein a ratio between a dimension of said negative pressure producing member before it is accommodated in said first accommodating chamber and an inside dimension of said first accommodating chamber is different for different regions of said first accommodating chamber, and the ratio is larger for a region interposed between said ink supply opening and said groove than for another region.

5. An ink container according to claim 1, wherein said groove is enclosed with said partition wall.

6. An ink container according to claim 1, wherein a filter is provided in said ink supply opening adjacent said first accommodation portion, and said negative pressure producing member is press-contacted to said filter.

7. An ink container according to claim 1, wherein said first accommodating chamber includes a region not having the negative pressure producing member adjacent the air vent portion.

8. An ink container according to claim 1, wherein said container is provided with a stepped portion therein to fix said partition wall at a predetermined position.

9. An ink container according to claim 1, wherein at least one side of outer walls constituting said second accommodating chamber is substantially transparent.

10. An ink container according to claim 1, further comprising detecting means for detecting that an amount of the ink in said second accommodating chamber is lower than a predetermined level.

11. An ink container according to claim 10, wherein said detecting means includes a reflection plate in said second accommodating chamber.

12. An ink jet cartridge comprising an ink container as defined in claim 1 and an ink jet head joined with the ink supply opening of said ink container.

13. An ink jet recording device having an ink jet cartridge as defined in claim 12, wherein said ink jet head cartridge is detachably mountable relative to a main assembly of said ink jet device.

14. An ink container connectable with an ink jet head detachably mountable to an ink jet device, said ink container comprising:

a container having an opening portion;

an ink supply opening formed in a side faced to said opening portion, a portion defining said ink supply opening being projected inwardly of said container;

a negative pressure producing member inserted through said opening portion so as to be contacted to said side faced to said opening portion;

a partition wall contacted to said negative pressure producing member and hermetically contacted to internal walls of said container so as to divide said container into a first accommodation portion and a second accommodation portion, said first accommodation portion for containing said negative pressure producing member and said second accommodation portion for containing ink;

a cap member for constituting said second accommodation portion with said partition wall by closing the opening portion of said container;

wherein said partition wall defines a communicating portion opposed to said ink supply opening, said communicating portion for permitting movement of the ink from said second accommodation portion to said first accommodation portion and movement of air from said first accommodation portion to said second accommodation portion, and said partition wall is provided with a groove extended from said communicating portion to a point away from an end of said partition wall remote from said communicating portion, said groove for facilitating movement of ink from said second accommodation portion to said first accommodation portion and the movement of air from said first accommodation portion to said second accommodation portion;

wherein a first portion of said negative pressure producing member that is between said ink supply opening and said communicating portion has a uniformly compressed region in which said negative pressure producing member is uniformly compressed at a compression ratio more than that of portions other than said first portion; and wherein said first portion further has a non-uniformly compressed region in which said negative pressure producing member is non-uniformly compressed.

15. An ink container according to claim 14, wherein a ratio between a length from said partition wall to the inward projected portion and a length from said partition wall to a region of said first accommodation portion not having said ink supply opening, is ⅔ to ¾.

16. An ink container according to claim 15, wherein a depth of said container is longer than a length from said partition wall to said region of said first accommodation portion not having said ink supply opening.

17. An ink container according to claim 14, wherein a depth of said container is longer than a length from said partition wall to said region of said first accommodation portion not having said ink supply opening.

18. An ink container according to claim 14, wherein a ratio between a dimension of said negative pressure producing member before it is accommodated in said first accommodation portion and an inside dimension of said first accommodation portion is different for different regions of said first accommodation portion, and the ratio is larger for a region interposed between said ink supply opening and said groove than for another region.

19. An ink container according to claim 14, wherein said groove is enclosed with said partition wall.

20. An ink container according to claim 14, wherein a filter is provided in said ink supply opening adjacent said first accommodation portion, and said negative pressure producing member is press-contacted to said filter.

21. An ink container according to claim 14, wherein said first accommodation portion includes a region not having the negative pressure producing member adjacent the air vent portion.

22. An ink container according to claim 14, wherein said container is provided with a stepped portion therein to fix said partition wall at a predetermined position.

23. An ink container according to claim 14, wherein at least one side of outer walls constituting said second accommodation portion is substantially transparent.

24. An ink container according to claim 14, further comprising detecting means for detecting that an amount of the ink in said second accommodation portion is lower than a predetermined level.

25. An ink container according to claim 24, wherein said detecting means includes reflection plate in said second accommodation portion.

26. An ink jet cartridge comprising an ink container as defined in claim 14 and an ink jet head joined with said ink supply opening of said ink container.

27. An ink jet cartridge according to claim 26, wherein said ink jet head has a liquid flow path having an ejection outlet through which the ink is ejected and a heat generating resistor for ejecting the ink through the ink ejection outlet.

28. An ink jet recording device having an ink jet cartridge as defined in claim 26, wherein said ink jet head cartridge is detachably mountable relative to a main assembly of said ink jet device.

29. An ink container connectable with an ink jet head detachably mountable to an ink jet device, said ink container comprising:

a container body;

a partition wall dividing an inside of said body into a first accommodating chamber and a second accommodating chamber;

wherein said first accommodating chamber contains a negative pressure producing member and is provided with an ink supply opening connectable with said ink jet head to supply ink and an air vent portion for communication with ambience, said ink supply opening being formed in a wall faced to said partition wall, a portion defining said ink supply opening being projected inwardly of said first accommodating chamber;

wherein said second accommodating chamber is provided with ink;

wherein said partition wall defines a communicating portion opposed to said ink supply opening, said communicating portion for permitting movement of the ink from said second accommodating chamber to said first accommodating chamber and movement of air from said first accommodating chamber to said second accommodating chamber;

wherein a first portion of said negative pressure producing member that is between said ink supply opening and said communicating portion has a uniformly compressed region in which said negative pressure producing member is uniformly compressed at a compression ratio more than that of portions other than said first portion; and wherein a region adjacent said first portion has a non-uniformly compressed region in which said negative pressure producing member is non-uniformly compressed.

* * * * *